US007648410B2

(12) United States Patent
Choi

(10) Patent No.: US 7,648,410 B2
(45) Date of Patent: Jan. 19, 2010

(54) POLISHING PAD AND CHEMICAL MECHANICAL POLISHING APPARATUS

(75) Inventor: Jae Young Choi, Dong-gu (KR)

(73) Assignee: Dongbu Hitek Co., Ltd., Seoul (KR)

( * ) Notice: Subject to any disclaimer, the term of this patent is extended or adjusted under 35 U.S.C. 154(b) by 188 days.

(21) Appl. No.: 11/830,925

(22) Filed: Jul. 31, 2007

(65) Prior Publication Data

US 2008/0045125 A1 Feb. 21, 2008

(30) Foreign Application Priority Data

Aug. 17, 2006 (KR) ..... 10-2006-077396

(51) Int. Cl.
*B24B 7/22* (2006.01)

(52) U.S. Cl. ..... 451/287; 451/527

(58) Field of Classification Search ..... 451/287, 451/288, 526, 527, 533, 534, 530
See application file for complete search history.

(56) References Cited

U.S. PATENT DOCUMENTS

2006/0046626 A1* 3/2006 Renteln ..... 451/527
2006/0160478 A1* 7/2006 Donohue et al. ..... 451/285

FOREIGN PATENT DOCUMENTS

JP 2005-158797 6/2005
KR 10-2004-0070767 8/2004
WO WO 2006/026271 A1 3/2006

* cited by examiner

*Primary Examiner*—Robert Rose
(74) *Attorney, Agent, or Firm*—Saliwanchik, Lloyd & Saliwanchik

(57) ABSTRACT

A polishing pad and a CMP apparatus are provided. The polishing pad includes a plurality of patterns formed of trenches having a predetermined size and may include a groove for slurry flow. The plurality of patterns can include herringbone shaped trenches in concentric rows, where the rows of herringbone shaped trenches alternate in direction.

14 Claims, 6 Drawing Sheets

POLISHING PAD AND CHEMICAL MECHANICAL POLISHING APPARATUS

CROSS-REFERENCE TO RELATED APPLICATION

The present application claims the benefit under 35 U.S.C. § 119 of Korean Patent Application No. 10-2006-077396, filed Aug. 17, 2006, which is hereby incorporated by reference in its entirety.

BACKGROUND

As a semiconductor device becomes more integrated, a multi-layered process is typically used. Photolithography processes are utilized in the multi-layered process, and ever smaller critical dimension margins are sought. To help minimize a line width formed on a material layer, the material layer on a chip is globally planarized. Currently, methods for planarizing a semiconductor device include boro-phosphosilicate glass (BPSG) reflow, aluminum (Al) flow, spin on glass (SOG) etch back, and chemical mechanical polishing (CMP).

CMP uses chemical components in a slurry solution and physical components of a polishing pad to chemically and mechanically polish the surface of a chip for planarization. This enables CMP to achieve global planarization and low-temperature planarization for a broad area, where a reflow process or an etch-back process is not able to be performed. Due to these advantages CMP is widely used as a planarization technique for next-generation semiconductor devices.

In a related art CMP apparatus, a nozzle supplies slurry while a pad rotates at a predetermined speed. A carrier applies a predetermined pressure on a wafer attached to the pad, and rotates at a predetermined speed.

A deposited layer on a wafer can be polished by this CMP process. The rotating pad, rotating carrier, and pressure on the wafer serve as physical components, while the slurry chemically interacts with the layer deposited on the wafer.

Performing the CMP polishing process often leads to the pad becoming smoother and losing surface roughness. If the surface roughness of the pad is not restored to its former condition, the polishing speed and uniformity during the subsequent processes will be degraded.

In order to provide additional surface roughness and to supply new slurry to the pad between polishing processes, the pad is typically pressed in a predetermined conditioning pressure by using a rotating circular disk.

FIG. 1 is a view of a related art CMP apparatus.

Referring to FIG. 1, a wafer 100 is polished by a pad 110 and slurry 120, and a polishing table 130 attached to the pad 110 performs a simple rotating movement. A head 140 also performs a rotating movement and applies a predetermined pressure on the wafer 100.

The wafer 100 uses a pad conditioner to condition the surface of the pad 110 such that the damage of the pad 110 after polishing can be recovered. Then, the next wafer is processed.

FIG. 2 is a top view of a head and a pad in a CMP apparatus. FIG. 3 is a graph of rotating speed with respect to wafer radius. FIG. 4 is a graph of polishing rate with respect to wafer radius.

As illustrated in FIG. 2, when the pad 110 and the head 140 rotate in the same direction, the rotating speed increases as points of the pad 110 are located closer to the outer circumference of the pad 110. Therefore, the polishing rate of a wafer disposed below the head 140 also increases as the radius of the pad 110 is closer to the outer circumference.

More specifically, as illustrated in FIG. 4, the polishing rate increases from the center of the wafer to the outer circumference. Furthermore, the rate at which the polishing rate increases also goes up from the center to the outer circumference of the wafer 100. This occurs because the head applies different pressure on the wafer, which is caused by different rotating speeds (distance per time unit) at each point.

The rotating speed increases from the center toward the outer circumference of the wafer such that the edge portion is more polished than the center of the wafer.

When the pad 110 and the head 140 rotate, the wafer is not uniformly polished. This leads to irregularities in the semiconductor device being polished and deterioration of its characteristics. Thus, there exists a need in the art for an improved CMP technique for planarizing a semiconductor device.

BRIEF SUMMARY

Embodiments of the present invention provide a polishing pad and CMP apparatus capable of uniformly polishing a wafer.

In many embodiments, the polishing pad includes: a groove for a slurry flow and a plurality of patterns formed of trenches having a predetermined size. In an alternative embodiment, the polishing pad does not include a groove for slurry flow.

In another embodiment, the CMP apparatus includes a polishing table rotating in a predetermined direction, a polishing pad formed on the polishing table, and a head applying a predetermined pressure to the polishing pad and surface of the wafer. The polishing pad has a plurality of patterns formed of trenches. In many embodiments, each trench is in the shape of a herringbone. In a further embodiment, the polishing pad of the CMP apparatus also has a groove for slurry flow.

The invention is described in more detail below, with reference to the accompanying drawings. Other features of the invention will be apparent to those skilled in the art from the description and drawings.

DETAILED DESCRIPTION

Reference will now be made in detail to embodiments of the present disclosure, examples of which are illustrated in the accompanying drawings.

Figure 1:
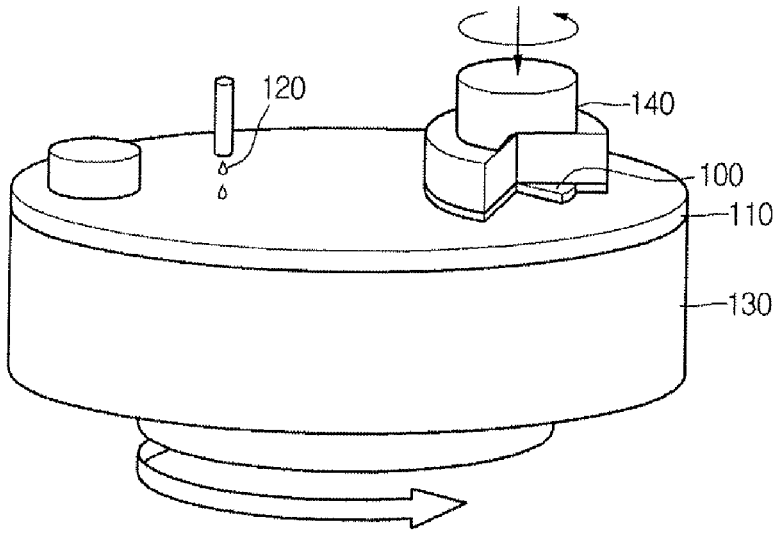
FIG. 1 is a view of a related art CMP apparatus.
Figure 2:
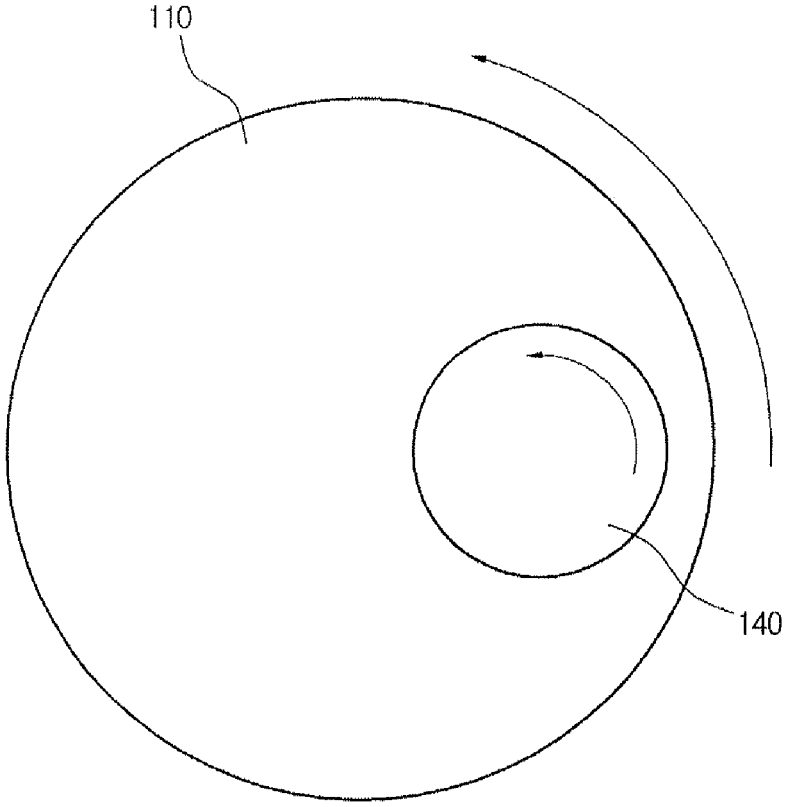
FIG. 2 is a top view of a head and a pad in a related art CMP apparatus.
Figure 3:
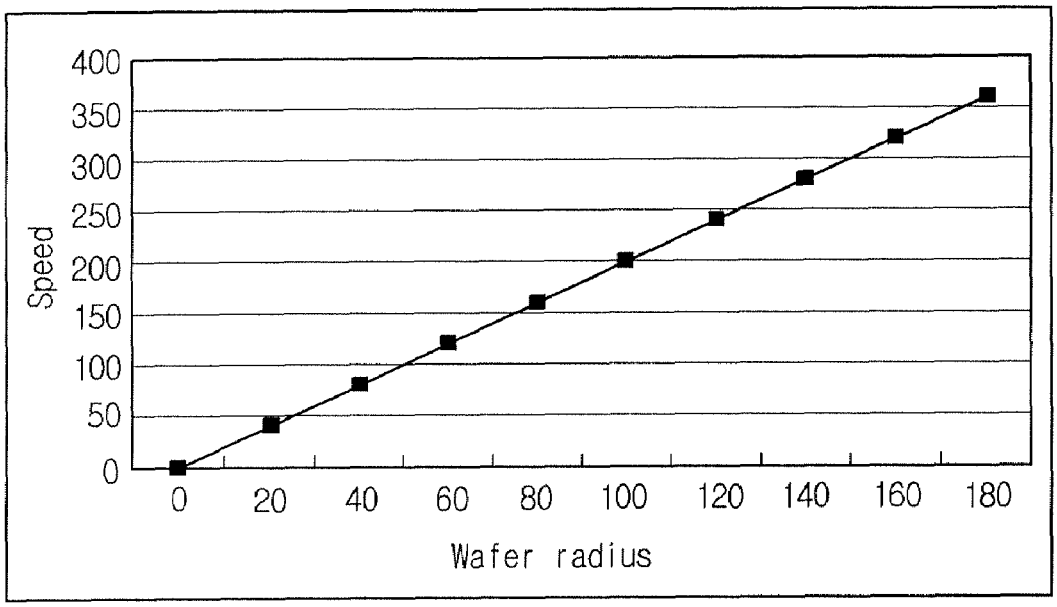
FIG. 3 is a graph of rotating speed with respect to wafer radius.
Figure 4:
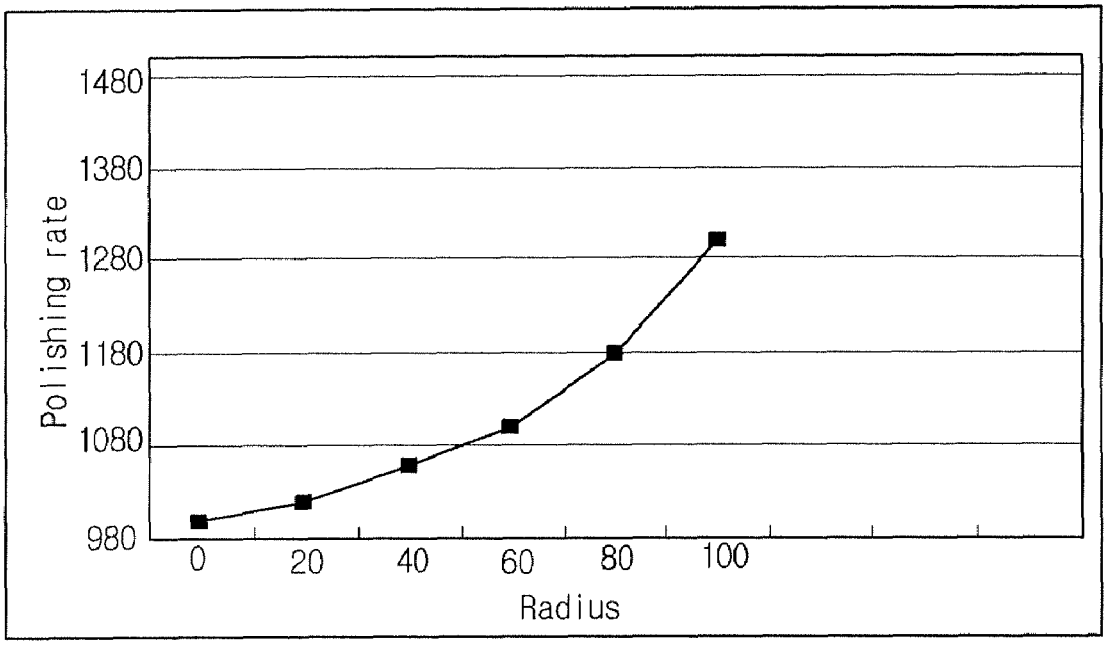
FIG. 4 is a graph of polishing rate with respect to wafer radius.
Figure 5:
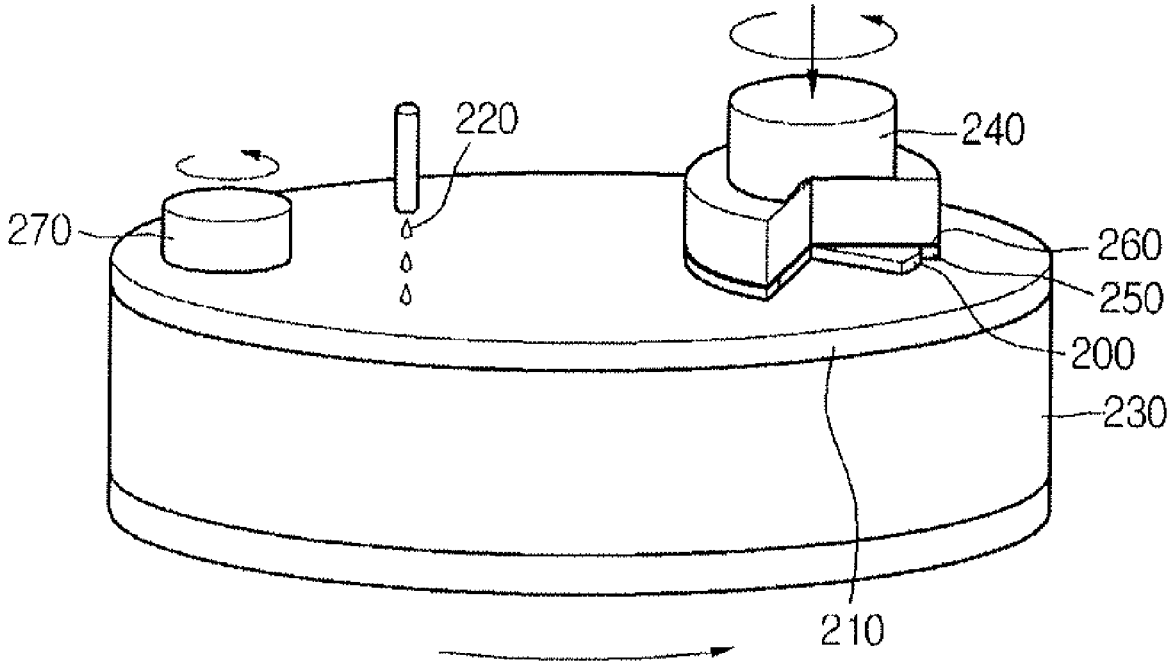
FIG. 5 is a view of a CMP apparatus according to an embodiment of the present invention.

Referring to FIG. 5, a CMP apparatus according to an embodiment of the present invention is shown, whereby a wafer 200 is polished by a polishing pad 210 and slurry 220.

A polishing table 230 having the polishing pad 210 thereon rotates, and a head 240 applies a predetermined pressure to the wafer 200 and also rotates.

In many embodiments, the weight of and pressure applied by the head 240 causes the surface of the wafer 200 to contact the polishing pad 210. The slurry 220, which is typically a processing or polishing solution, flows into fine gaps between contacting surfaces. The fine gaps can be trench patterns on the polishing pad (which will be described later). The polishing particles in the slurry 220 and protrusions on the surface of the polishing pad 210 perform a mechanical polishing process on the wafer 200. Additionally, chemical components in the slurry 220 chemically polish the wafer 200.

In certain embodiments, a supporting ring 250 and a baking film 260 may be formed between the wafer 200 and the head 240 and perform supporting and shock-absorbing functions.

In an embodiment, a pad conditioner 270 is included on the polishing pad 210 to remove polishing by-products and increase polishing efficiency and uniformity. The pad conditioner 270 is typically driven up and down on the polishing pad 210 by a pneumatic cylinder (not shown), and includes a cylindrical body connected to the pneumatic cylinder and a diamond disk surrounding an outer circumference of the cylindrical body.

Figure 6:
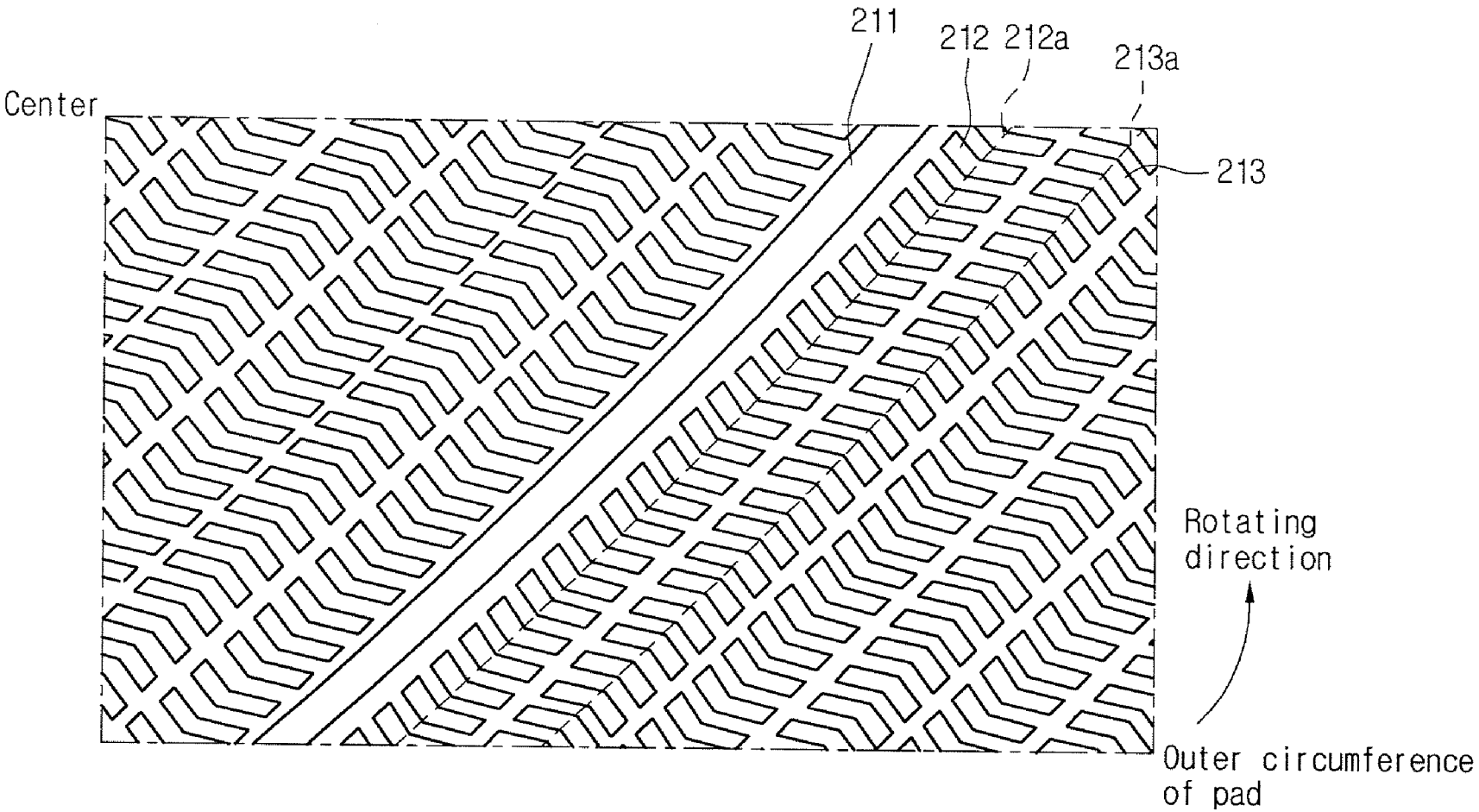
FIG. 6 is a view of a polishing pad according to an embodiment of the present invention.

As illustrated in FIG. 6, an embodiment of the polishing pad of the present invention includes a groove 211, which is carved to a predetermined depth on the polishing pad 210 to smoothly provide slurry.

In an embodiment, a plurality of trenches is formed around the groove 211 and can receive the slurry. Each trench has a predetermined pattern, such as a first pattern 212 and a second pattern 213. The first pattern 212 and second pattern 213 each comprise a herringbone design, though the joint of the herringbone opens in opposite directions in first pattern 212 and second pattern 213. The joints can be curved to form U-like herringbone shapes or rigid to form V-like herringbone shapes. In certain embodiments, all joints are rigid. In further embodiments, all joints are curved. In yet further embodiments, some joints are curved and some joints are rigid.

In certain embodiments, when the polishing pad 210 has a circular shape, the groove 211 also has a circular shape and is concentric with the outside circumference of the polishing pad 210. A plurality of the first patterns 212 is formed on the polishing pad concentrically around the groove 211. A plurality of the second patterns 213 is also formed concentrically around the groove 211 and trenches of each pattern are alternated as you move away from the groove 211 in either direction.

Thus, in certain embodiments, a first line 212*a* is formed by the first pattern 212, and a second line 213*a* is formed by the second pattern 213. Moving away from the center of the polishing pad 210 toward its outer circumference, first line 212*a* and second line 213*a* are alternately disposed.

In many embodiments, the first pattern 212 and the second pattern 213 each have a herringbone shape, but with the opening of the shape for one pattern facing the direction the polishing pad 210 rotates and the opening of the shape for the other pattern facing the opposite direction.

In an embodiment, the first pattern 212 and the second pattern 213 may each have a rounded bracket shape instead of a rigid angle. Typically, when the round bulge or sharp portion of the rounded bracket shape is disposed in the direction the polishing pad 210 is rotating, it is referred to as the second pattern 213; otherwise, it is referred to as the first pattern 212.

Figure 7:
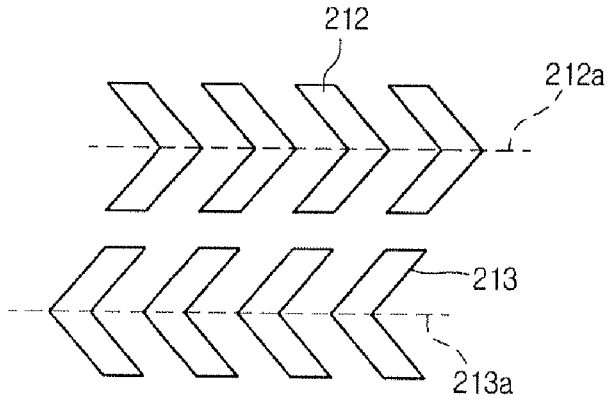
FIG. 7 is a view of the patterns of trenches of the polishing pad according to an embodiment of the present invention.

As illustrated in FIG. 7, many embodiments have two trenches 213 which converge at a predetermined point to form a V-shaped herringbone design. Each trench has a predetermined depth, typically in the range of about 50 μm to about 410 μm.

In many embodiments, the first pattern 212 and the second pattern 213 each have a bulge of a predetermined size. The bulge inside the second pattern 213 is formed in a direction opposite the rotating direction of the polishing pad 210.

Figure 8:
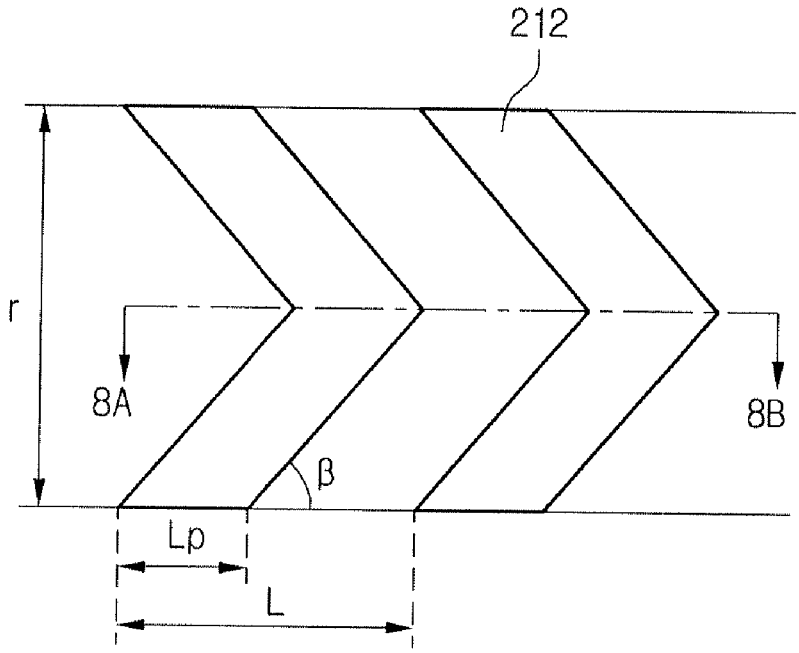
FIG. 8 is a view of the trenches of the polishing pad according to an embodiment of the present invention.
Figure 9:
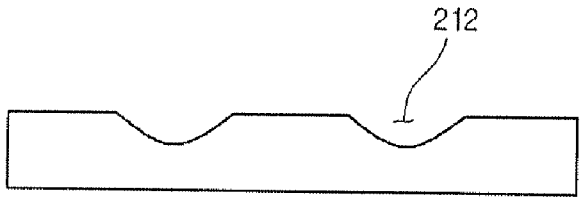
FIG. 9 is a side cutaway view of the polishing pad according to an embodiment of the present invention.

As seen in FIGS. 8 and 9, in certain embodiments, the first pattern 212 has a concave shape with a predetermined depth on the polishing pad 210. The concave shape allows the trenches to receive slurry for polishing the wafer. In many embodiments, the ratio ($\alpha$=Lp/L) of the thickness Lp of the first pattern 212 and the distance L between consecutive trenches in the first pattern 212 is between about 0.22 and about 0.5. In addition, pattern angle $\beta$ is between about 22 degrees and about 32 degrees. The length r of a vertical axis in the first pattern 212 ranges from about 0.5 mm to about 4 mm.

In many embodiments, the second pattern 213 can have the same ranges of values for $\alpha$, $\beta$, Lp, L, and r as the first pattern 212. Additionally, the second pattern 213 can have trenches of a concave shape, as shown for the first pattern 212 in FIG. 9.

Figure 10:
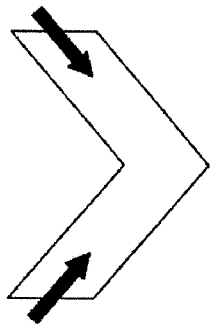
FIGS. 10 and 11 are views of a dynamic pressure effect due to a pattern with a herringbone groove.
Figure 11:
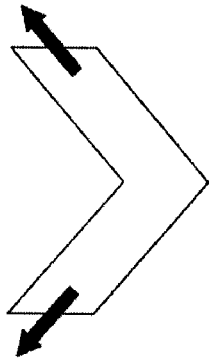

FIG. 10 illustrates an embodiment where fluid, such as air, is suctioned into the center of the pattern according to the revolutions of the polishing pad 210 and the head 240. FIG. 11 illustrates an embodiment where fluid, such as air, is dispelled from the center of the pattern.

Referring the embodiment shown in FIG. 10, when air flows into the center of the pattern through rotation of the polishing pad 210 and the head 240, a high pressure air moves toward the top of the polishing pad 210. The air from the top of the polishing pad 210 causes the weight and strength of the head 240 pressing down the polishing pad 210 to decrease, thereby decreasing the polishing rate of the wafer.

FIG. 11 shows an embodiment whereby air flows out of the center of the pattern through rotation of the polishing pad 210 and the head 240. This leads to a decrease in the pressure in the center of the pattern and an increase in the strength in the head 240 for pressing down the polishing pad. Therefore, the polishing rate of the wafer increases.

In an embodiment, the herringbone designs of the first pattern 212 and the second pattern 213 have opposite directions. By using air generated from rotations of the polishing pad 210 and the head 240, the pressure applied by the head 240 is uniformly distributed on the wafer 200.

The uniformly-applied pressure of the head 240 causes the polishing rate at each point of the wafer 200 to be approximately the same.

Figure 12:
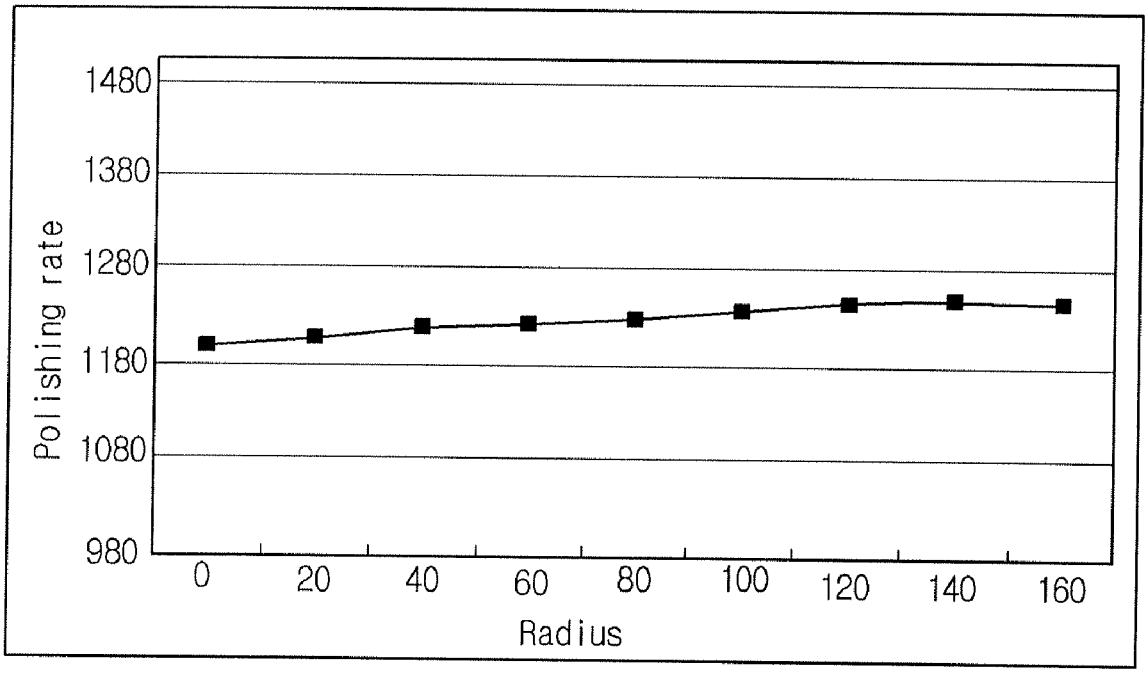
FIG. 12 is a graph of polishing rate with respect to wafer radius for a CMP apparatus according to an embodiment of the present invention.

FIG. 12 shows a graph of the polishing rate of a CMP apparatus with a polishing pad according to an embodiment.

As illustrated in FIG. 12, moving away from the center toward the outer circumference of the polishing pad 210, the polishing rate at each point is between about 1180 and about 1280, illustrating a uniform polishing process on the wafer 200.

In an embodiment, the trenches on the polishing pad 210 from the first pattern 212 line up with the trenches from the adjacent second pattern 213, such that the boundaries of the length Lp for trenches in the first pattern 212 are directly across from boundaries of the length Lp for trenches in the second pattern 213. In an alternative embodiment, the trenches on the polishing pad 210 from the first pattern 212 do not line up with the trenches from the adjacent second pattern 213.

In an embodiment, the polishing pad 210 has rows of a third pattern going circumferentially around the polishing pad 210. The third pattern has a design which is similar to two opposing herringbone designs connected; the designs have a first trench which then connects to a second trench which then connects to a third trench that is approximately parallel to the first trench. In one embodiment, the three trenches are each approximately the same length and width. In another embodiment, the second trench is approximately twice as long as the first and second trench. This can be accomplished by connecting the first pattern 212 and the second pattern 213 to form the third pattern. In an embodiment, adjacent third patterns have the boundary line length Lp of the trenches line up. In an alternative embodiment, the boundary line length Lp of trenches in adjacent patterns do not line up. In an embodiment, the joints are rigid. In a further embodiment, the joints are curved. In another embodiment, some joints are curved and some joints are rigid. In yet another embodiment, the polishing pad 210 has a circular groove 211, which is concentric with the outside circumference of the polishing pad 210.

In a further embodiment, the polishing pad 210 has rows of directionally alternating third patterns going circumferentially around the polishing pad 210. In another embodiment, alternating rows of first and second patterns can include a number of rows of first patterns followed by a number of rows of second patterns followed by a number of rows of first patterns.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification do not necessarily all refer to the same embodiment. Furthermore, when a particular feature, structure, or characteristic is described in connection with any embodiment, it is to be understood that it is within the purview of one skilled in the art to effect such feature, structure, or characteristic in connection with other embodiments.

Although the invention has been described with reference to certain embodiments, it should be understood that numerous other modifications and embodiments can be devised by those skilled in the art that will fall within the spirit and scope of the principles of this disclosure and the appended claims. More particularly, various variations and modifications are possible in the component parts and/or arrangements of the subject combination arrangement within the scope of the disclosure, the drawings, and the appended claims. In addition to variations and modifications in the component parts and/or arrangements, alternative uses will also be apparent to those skilled in the art.

What is claimed is:

1. A polishing pad, comprising:

a first pattern comprising a herringbone pattern of two trenches formed in a pad material connected at a first joint, wherein the first joint is directed toward a direction of rotation;

a second pattern comprising a herringbone pattern of two trenches formed in the pad material connected at a second joint, wherein the second joint is directed toward the opposite direction of the first joint; and a groove for slurry flow formed in the pad material concentric with the outside circumference of the polishing pad.

2. The polishing pad according to claim 1, wherein a pattern angle (β) of the first pattern is between about 22 degrees and about 32 degrees; and wherein a pattern angle (β) of the second pattern is between about 22 degrees and about 32 degrees.

3. The polishing pad according to claim 1, wherein the ratio (Lp:L) of the length (Lp) across a trench of the first pattern and the distance (L) between consecutive trenches in the first pattern is between about 0.22 and about 0.5; and wherein the ratio (Lp:L) of the length (Lp) across a trench and the distance (L) between consecutive trenches in the second pattern is between about 0.22 and about 0.5.

4. The polishing pad according to claim 1, wherein the length (r) from a distal end of a first trench to a distal end of a second trench of the two trenches of the first pattern is between about 0.5 mm and about 4 mm; and wherein the length (r) from a distal end of a first trench to a distal end of a second trench of the two trenches of the second pattern is between about 0.5 mm and about 4 mm.

5. The polishing pad according to claim 1, wherein the depth of the trenches of the first pattern is between about 50 μm to about 410 μm; and wherein the depth of the trenches in the second pattern is between about 50 μm to about 410 μm.

6. The polishing pad according to claim 1, wherein the trenches in the first pattern are concave; and wherein the trenches of the second pattern are concave.

7. A polishing pad, comprising:

a first pattern comprising a herringbone pattern of two trenches formed in a pad material connected at a first joint, wherein the first joint is directed toward a direction of rotation; and a second pattern comprising a herringbone pattern of two trenches formed in the pad material connected at a second joint, wherein the second joint is directed toward the opposite direction of the first joint;

wherein a first row comprising a plurality of first patterns and a second row comprising a plurality of second patterns are formed as alternating concentric rows on the pad material.

8. The polishing pad according to claim 7, wherein an outer side of the first pattern of the first row lines up with an outer side of the second pattern of the second row.

9. The polishing pad according to claim 7, wherein each first pattern of the first row connects to a corresponding second pattern of the second row, thereby forming a third row of third patterns, wherein concentric third rows are formed on the pattern material.

10. The polishing pad according to claim 9, wherein the concentric third rows alternate in direction.

11. A CMP apparatus comprising:

a polishing table capable of rotating;

a polishing pad, comprising:

a first pattern comprising a herringbone pattern of two trenches formed in a pad material connected at a first joint, wherein the first joint is directed toward a direction of rotation, and a second pattern comprising a herringbone pattern of two trenches formed in the pad material connected at a second joint, wherein the second joint is directed toward the opposite direction of the first joint; and a head for applying a pressure to the polishing pad to polish a surface of a wafer;

wherein the polishing pad further comprises a groove for slurry flow formed in the pad material which is concentric with the outside circumference of the polishing pad.

12. A CMP apparatus comprising:

a polishing table capable of rotating;

a polishing pad, comprising:

a first pattern comprising a herringbone pattern of two trenches formed in a pad material connected at a first joint, wherein the first joint is directed toward a direction of rotation, and a second pattern comprising a herringbone pattern of two trenches formed in the pad material connected at a second joint, wherein the second joint is directed toward the opposite direction of the first joint; and a head for applying a pressure to the polishing pad to polish a surface of a wafer;

wherein a first row comprising a plurality of first patterns and a second row comprising a plurality of second patterns are formed as alternating concentric rows on the pad material.

13. The CMP apparatus according to claim 11, wherein rotation of the polishing pad causes fluid to flow toward the joint of the second pattern, which increases strength in the head; and causes fluid to flow away from the joint of the first pattern, which decreases strength in the head.

14. The CMP apparatus according to claim 13, wherein pressure applied by the head is uniformly distributed on the wafer.

* * * * *